US008810488B2

(12) United States Patent
Senda

(10) Patent No.: US 8,810,488 B2
(45) Date of Patent: Aug. 19, 2014

(54) DISPLAY DEVICE AND METHOD FOR DRIVING THE SAME

(75) Inventor: Takahiro Senda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 213 days.

(21) Appl. No.: 13/384,867

(22) PCT Filed: Mar. 17, 2010

(86) PCT No.: PCT/JP2010/054492

§ 371 (c)(1),
(2), (4) Date: Jan. 19, 2012

(87) PCT Pub. No.: WO2011/010486

PCT Pub. Date: Jan. 27, 2011

(65) Prior Publication Data

US 2012/0120046 A1 May 17, 2012

(30) Foreign Application Priority Data

Jul. 23, 2009 (JP) ..... 2009-172149

(51) Int. Cl.
*G09G 3/30* (2006.01)

(52) U.S. Cl.
USPC ..... 345/80; 345/206

(58) Field of Classification Search
USPC ..... 345/76–83, 204–206, 211, 214; 250/552, 553; 313/463, 498, 506, 509, 313/512; 315/169.3; 362/230, 231
See application file for complete search history.

(56) References Cited

U.S. PATENT DOCUMENTS

| | | | | |
|---|---|---|---|---|
| 6,380,689 | B1 | 4/2002 | Okuda | |
| 6,583,775 | B1 | 6/2003 | Sekiya et al. | |
| 8,094,144 | B2 * | 1/2012 | Miyazawa | 345/207 |
| 8,362,985 | B2 * | 1/2013 | Seto | 345/82 |
| 2002/0047852 | A1 | 4/2002 | Inukai et al. | |

(Continued)

FOREIGN PATENT DOCUMENTS

| | | | |
|---|---|---|---|
| JP | 2001-60076 | A | 3/2001 |
| JP | 2001-109432 | A | 4/2001 |

(Continued)

OTHER PUBLICATIONS

International Search Report received for PCT Patent Application No. PCT/JP2010/054492, mailed on Jun. 15, 2010, 5 pages (2 pages of English translation and 3 pages of PCT Search Report).

*Primary Examiner* — Tom Sheng
(74) *Attorney, Agent, or Firm* — Morrison & Foerster LLP

(57) ABSTRACT

An erasing TFT 13 is provided between a gate terminal of a driving TFT 11 and a control line Ei, and a gate terminal of the erasing TFT 13 is connected to the control line Ei. When performing data erase, a potential not lower than a sum of a potential of a power supply line Vp and a threshold voltage of the erasing TFT 13 is applied to the control line Ei before performing data write, and an organic EL element 15 is controlled to be in a non-light-emitting state. A high level potential applied to a control line Wi is a potential at which a writing TFT 12 is maintained in an OFF state when a potential applied to a data line Sj is a high level potential corresponding to the non-light-emitting state. Accordingly, it is possible to prevent electrooptic elements from emitting light unnecessarily along with changes of potentials of the control lines without increasing the number of power supply or wiring.

14 Claims, 6 Drawing Sheets

(56) References Cited

U.S. PATENT DOCUMENTS

| | | | | |
|---|---|---|---|---|
| 2003/0160745 | A1* | 8/2003 | Osame et al. | 345/82 |
| 2004/0100304 | A1* | 5/2004 | Kawase et al. | 326/86 |
| 2004/0263440 | A1* | 12/2004 | Kimura et al. | 345/76 |
| 2006/0221010 | A1* | 10/2006 | Omata | 345/76 |
| 2006/0238135 | A1 | 10/2006 | Kimura | |
| 2007/0046591 | A1 | 3/2007 | Shishido et al. | |
| 2007/0126667 | A1* | 6/2007 | Nakamura et al. | 345/76 |
| 2007/0152921 | A1 | 7/2007 | Osame | |
| 2008/0100543 | A1* | 5/2008 | Kasai et al. | 345/77 |
| 2009/0033600 | A1* | 2/2009 | Osame et al. | 345/76 |
| 2009/0058843 | A1 | 3/2009 | Ishizuka | |
| 2009/0079350 | A1 | 3/2009 | Osame et al. | |

FOREIGN PATENT DOCUMENTS

| | | | |
|---|---|---|---|
| JP | 2002-149113 | A | 5/2002 |
| JP | 2006-323371 | A | 11/2006 |
| JP | 2006-323376 | A | 11/2006 |
| JP | 2007-86762 | A | 4/2007 |
| JP | 2007-140490 | A | 6/2007 |
| WO | 2007/010956 | A1 | 1/2007 |

* cited by examiner

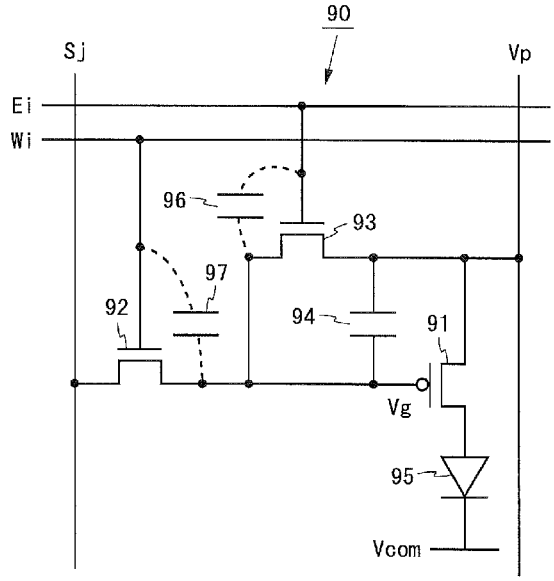
*Fig. 10*
Prior Art
*Fig. 11* Prior Art
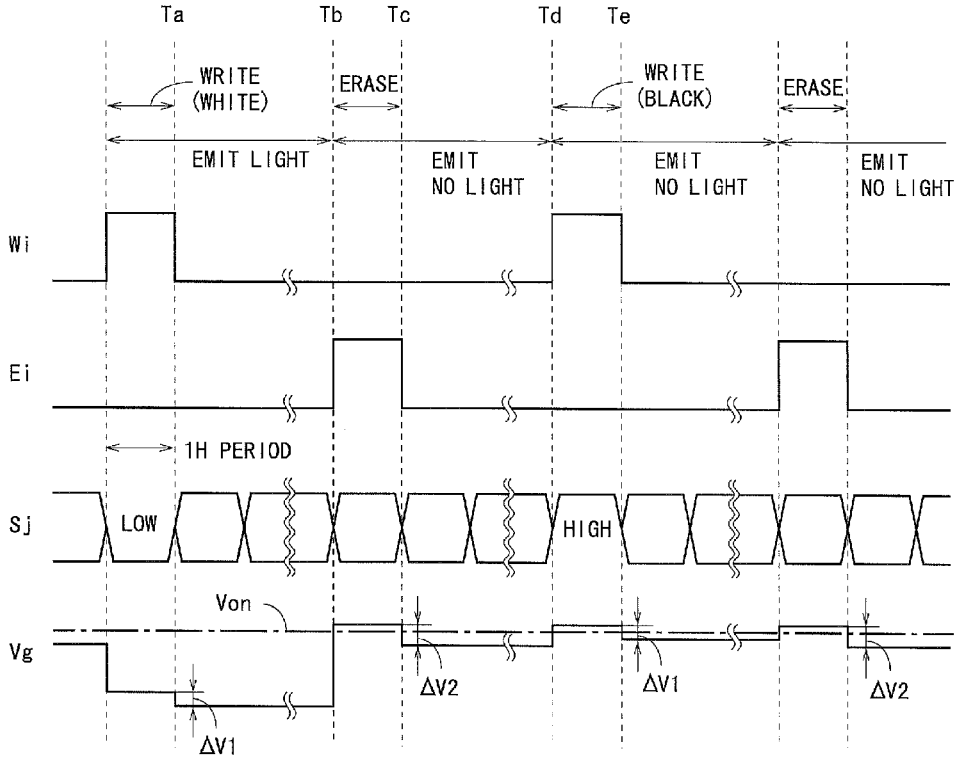

DISPLAY DEVICE AND METHOD FOR DRIVING THE SAME

CROSS REFERENCE TO RELATED APPLICATIONS

This is a U.S. National Phase patent application of PCT/JP2010/054492, filed Mar. 17, 2010, which claims priority to Japanese Patent Application No. 2009-172149, filed Jul. 23, 2009, each of which is hereby incorporated by reference in the present disclosure in its entirety.

TECHNICAL FIELD

The present invention relates to display devices, and in particular to a current-driven type display device such as an organic EL display.

BACKGROUND ART

In recent years, organic EL (Electro Luminescence) displays have been gaining attention as thin, lightweight, and fast-responsive display devices. As a method of performing gradation display with an organic EL display, there is known analog gradation driving for controlling a driving TFT (Thin Film Transistor) within a pixel circuit using an analog signal, and digital gradation driving for controlling the driving TFT using a digital signal. Compared to the analog gradation driving, the digital gradation driving provides higher tone reproduction and superior image quality.

In the following description, time-division gradation driving as one type of the digital gradation driving is taken as an example. The time-division gradation driving is a driving method in which one frame period is divided into a plurality of sub-frame periods, and a state of a display element is controlled to be in a light-emitting state or in a non-light-emitting state in each sub-frame period. Brightness of the display element in one frame period is determined based on a total length of sub-frame periods in which the display element is in the light-emitting state. The time-division gradation driving is used for driving of PDPs (Plasma Display Panels) as well.

There have been proposed various pixel circuits for the organic EL display (in the conventional pixel circuits described below, names of the components and the signal lines are changed in order to simplify comparison with the present invention). As shown in FIG. 6, Patent Document 1 describes a pixel circuit 60 including TFTs 61 to 63, a capacitor 64, and an organic EL element 65. As shown in FIG. 7, a potential of a control line Ei changes with a delay of a predetermined time from a potential of a control line Wi. When the potential of the control line Ei becomes a high level, the TFT 63 is turned to an ON state, the TFT 61 is turned to an OFF state, and the organic EL element 65 is turned to a non-light-emitting state. Therefore, it is possible to adjust display brightness of the organic EL element 65 by adjusting the length of delay time shown in FIG. 7.

As shown in FIG. 8, Patent Document 2 describes a pixel circuit 70 including TFTs 71 to 73, a capacitor 74, and an organic EL element 75. When a potential of a control line Ei becomes a high level, the TFT 73 is turned to an ON state, the TFT 71 is turned to an OFF state, and the organic EL element 75 is turned to a non-light-emitting state. The TFT 73 is provided for an organic EL display performing time-division gradation driving, in order to carry out writing and erasing of data in parallel.

As shown in FIG. 9, Patent Document 3 describes a pixel circuit 80 including TFTs 81 to 83, a capacitor 84, and an organic EL element 85. In the pixel circuit 80, a gate terminal and a drain terminal of the TFT 83 are connected to a control line Ei. When a potential of the control line Ei becomes a high level, a current flows from the control line Ei to a gate terminal of the TFT 81 through the TFT 83, the TFT 81 is turned to an OFF state, and the organic EL element 85 is turned to a non-light-emitting state. The TFT 83 is provided for an organic EL display performing time-division gradation driving and area-division gradation driving, in order to carry out writing and erasing of data in parallel. As described above, providing a TFT for data erase for a pixel circuit of an organic EL display separately from a TFT for data write has been conventionally known.

PRIOR ART DOCUMENTS

Patent Documents

[Patent Document 1] Japanese Laid-Open Patent Publication No. 2001-60076

[Patent Document 2] Japanese Laid-Open Patent Publication No. 2002-149113

[Patent Document 3] Japanese Laid-Open Patent Publication No. 2007-86762

SUMMARY OF THE INVENTION

Problems to be Solved by the Invention

To a pixel circuit of an organic EL display performing time-division gradation driving, one of data corresponding to a light-emitting state of the organic EL element (hereinafter referred to as white data) and data corresponding to a non-light-emitting state of the organic EL element (hereinafter referred to as black data) is written. However, there is a case in which the organic EL element emits light at brightness of an extremely low level even after the black data is written into the pixel circuit or after the written data is erased, resulting in a bright spot appearing in the screen or the entire screen emitting light at low brightness. In the following, the reason of this is described with reference to FIG. 10 and FIG. 11.

A pixel circuit 90 shown in FIG. 10 includes a driving TFT 91, a writing TFT 92, an erasing TFT 93, a capacitor 94, and an organic EL element 95. As shown in FIG. 11, when writing white data (black data) to the pixel circuit 90, a potential of a data line Sj is controlled to be a low level (high level), and a potential of a control line Wi is controlled to be a high level. When erasing the written data, a potential of a control line Ei is controlled to be a high level. The potentials of the control lines Wi and Ei are both controlled to be a high level only for one horizontal scanning period (1H period).

At a time point Tb, when the potential of the control line Ei changes to a high level, the erasing TFT 93 is turned to an ON state, and a gate potential Vg of the driving TFT 91 becomes equal to a potential of a power supply line Vp. Thereafter, at a time point Tc, when the potential of the control line Ei changes to a low level and the erasing TFT 93 is turned to an OFF state, the gate potential vg is not supposed to change. However, in practice, as there is a parasitic capacitance 96 between a gate terminal and a source terminal of the erasing TFT 93, the gate potential Vg decreases by $\Delta V2$ at the time point Tc at which the potential of the control line Ei changes to a low level. At this time, if the gate potential Vg becomes lower than an ON-potential Von of the driving TFT 91, the organic EL element 95 unnecessarily emits light at and after the time point Tc.

A similar phenomenon also occurs when writing black data. At time point Td, when the potentials of the control line Wi and the data line Sj both change to a high level, the writing TFT 92 is turned to an ON state, and the gate potential Vg becomes equal to the potential of the data line Sj. Thereafter, at a time point Te, when the potential of the control line Wi changes to a low level and the writing TFT 92 is turned to an OFF state, the gate potential Vg is not supposed to change. However, in practice, as there is a parasitic capacitance 97 between a gate terminal of the writing TFT 92 and a conducting terminal of the writing TFT 92 on a side of the driving TFT 91, the gate potential Vg decreases by ΔV1 at the time point Te at which the potential of the control line Wi changes to a low level. At this time, if the gate potential Vg becomes lower than the ON-potential Von of the driving TFT 91, the organic EL element 95 unnecessarily emits light at and after the time point Te.

It should be noted that when white data is written, the gate potential Vg also decreases at a time point Ta at which the potential of the control line Wi changes to a low level. At this time, the organic EL element 95 still emits light even though the gate potential Vg decreases, and there is no problem in an operation of the pixel circuit 90.

Unnecessary light emission after data erase can be prevented by applying a potential sufficiently higher than the ON-potential Von of the driving TFT 91 to a drain terminal of the erasing TFT 93. However, in the pixel circuit 90, the drain terminal of the erasing TFT 93 is connected to the power supply line Vp together with a source terminal of the driving TFT 91, in order to reduce the number of power supply and the number of wiring. Accordingly, in the pixel circuit 90, it is not possible to freely apply a potential to the drain terminal of the erasing TFT 93.

Further, unnecessary light emission after writing of black data can be prevented by applying a sufficiently high potential to the data line Sj when writing black data. However, in order to apply a high level potential other than the potential of the power supply line Vp to the data line Sj, a power supply is necessary to produce this potential, and thus a circuit amount of the display device increases.

It is not possible to solve this problem even with the conventional pixel circuits 60, 70, and 80 shown in FIG. 6, FIG. 8, and FIG. 9. This problem occurs in a pixel circuit having a driving TFT that is highly conductive and applying a potential that is close to a source potential to a gate terminal of the driving TFT when erasing data.

Thus, an object of the present invention is to provide a display device capable of preventing an electrooptic element from unnecessarily emitting light when a potential of a control line changes, without increasing the number of power supply or wiring.

Means for Solving the Problems

According to a first aspect of the present invention, there is provided a display device of a current-driven type, the display device including: a plurality of pixel circuits arranged two-dimensionally; a plurality of first control lines and a plurality of second control lines, each first control line and each second control line being provided for each row of the pixel circuits; a plurality of data lines, each provided for each column of the pixel circuits; a control line drive circuit configured to select pixel circuits as a target of data write using the first control lines, and to select pixel circuits as a target of data erase using the second control lines; and a data line drive circuit configured to apply potentials corresponding to binary display data to the data lines, wherein each pixel circuit includes: an electrooptic element provided between a first power supply line and a second power supply line; a driving transistor provided between the first power supply line and the second power supply line, and in series with the electrooptic element; a writing transistor provided between a gate terminal of the driving transistor and a corresponding one of the data lines, and having a gate terminal connected to a corresponding one of the first control lines; an erasing transistor provided between the gate terminal of the driving transistor and a predetermined signal line, and having a gate terminal connected to a corresponding one of the second control lines; and a capacitor provided between the gate terminal of the driving transistor and the first power supply line, the second control line is applied with a data erasing potential until a potential applied to the first control line changes to a data writing potential, and the data writing potential applied to the first control line is a potential at which the writing transistor is maintained in an OFF state when a potential applied to the data line is a non-light-emitting potential corresponding to a non-light-emitting state of the electrooptic element.

According to a second aspect of the present invention, in the first aspect of the present invention, the data writing potential applied to the first control line is equal to the non-light-emitting potential applied to the data line.

According to a third aspect of the present invention, in the second aspect of the present invention, the non-light-emitting potential applied to the data line is equal to a potential of the first power supply line.

According to a fourth aspect of the present invention, in the first aspect of the present invention, the erasing transistor is provided between the gate terminal of the driving transistor and the second control line.

According to a fifth aspect of the present invention, in the fourth aspect of the present invention, the data erasing potential applied to the second control line is not lower than a sum of a potential of the first power supply line and a threshold voltage of the erasing transistor.

According to a sixth aspect of the present invention, in the first aspect of the present invention, the control line drive circuit and the data line drive circuit perform time-division gradation driving in which one frame period is divided into a plurality of sub-frame periods and a state of the electrooptic element is controlled in each sub-frame period.

According to a seventh aspect of the present invention, in the first aspect of the present invention, the electrooptic element is configured as an organic EL element.

According to an eighth aspect of the present invention, there is provided a method for driving a display device provided with: a plurality of pixel circuits arranged two-dimensionally; a plurality of first control lines and a plurality of second control lines, each first control line and each second control line being provided for each row of the pixel circuits; and a plurality of data lines, each provided for each column of the pixel circuits, each pixel circuit including: an electrooptic element provided between a first power supply line and a second power supply line; a driving transistor provided between the first power supply line and the second power supply line, and in series with the electrooptic element; a writing transistor provided between a gate terminal of the driving transistor and a corresponding one of the data lines, and having a gate terminal connected to a corresponding one of the first control lines; an erasing transistor provided between the gate terminal of the driving transistor and a predetermined signal line, and having a gate terminal connected to a corresponding one of the second control lines; and a capacitor provided between the gate terminal of the driving transistor and the first power supply line, the method including: a step of selecting pixel circuits as a target of data write using the first control lines; a step of selecting pixel circuits as a target of data erase using the second control lines; and a step of applying potentials corresponding to binary display data to the data lines, wherein the second control line is applied with a data erasing potential until a potential applied to the first control line changes to a data writing potential, and the data writing potential applied to the first control line is a potential at which the writing transistor is maintained in an OFF state when a potential applied to the data line is a non-light-emitting potential corresponding to a non-light-emitting state of the electrooptic element.

According to a ninth aspect of the present invention, in the eighth aspect of the present invention, the data writing potential applied to the first control line is equal to the non-light-emitting potential applied to the data line.

According to a tenth aspect of the present invention, in the ninth aspect of the present invention, the non-light-emitting potential applied to the data line is equal to a potential of the first power supply line.

According to an eleventh aspect of the present invention, in the eighth aspect of the present invention, the erasing transistor is provided between the gate terminal of the driving transistor and the second control line.

According to a twelfth aspect of the present invention, in the eleventh aspect of the present invention, the data erasing potential applied to the second control line is not lower than a sum of a potential of the first power supply line and a threshold voltage of the erasing transistor.

According to a thirteenth aspect of the present invention, in the eighth aspect of the present invention, in the three steps, time-division gradation driving is performed, in which one frame period is divided into a plurality of sub-frame periods and a state of the electrooptic element is controlled in each sub-frame period.

According to a fourteenth aspect of the present invention, in the eighth aspect of the present invention, the electrooptic element is configured as an organic EL element.

Effects of the Invention

According to the first or eighth aspect of the present invention, data erase to a pixel circuit is performed and the electrooptic element is controlled to be in the non-light-emitting state until data write is performed to the pixel circuit. Further, when writing black data corresponding to the non-light-emitting state of the electrooptic element to the pixel circuit, the writing transistor is maintained in the OFF state. Accordingly, it is possible to control the electrooptic element to be in the non-light-emitting state corresponding to the black data without writing the black data, and to prevent a gate potential of the driving transistor from changing along with a change of a potential of the first control line when the data write ends. Therefore, it is possible to prevent the electrooptic element from emitting light unnecessarily after writing of the black data.

According to the second or ninth aspect of the present invention, by making a data writing potential applied to the first control line equal to a potential corresponding to the black data applied to the data line, it is possible to prevent the electrooptic element from emitting light unnecessarily after writing of the black data without increasing power supply for generating the data writing potential.

According to the third or tenth aspect of the present invention, by making the potential corresponding to the black data applied to the data line equal to a potential of the first power supply line, it is possible to prevent the electrooptic element from emitting light unnecessarily after writing of the black data without increasing power supply for generating the potential corresponding to the black data.

According to the fourth or eleventh aspect of the present invention, by connecting one of the conducting terminals and the gate terminal of the erasing transistor to the second control line, it is possible to apply an adequate potential to the gate terminal of the driving transistor using the second control line, and to reliably control the electrooptic element to be in the non-light-emitting state during the data erase. Moreover, by applying a potential including a margin to the second control line, even when the potential of the second control line changes and the gate potential of the driving transistor changes when the data erase ends, it is possible to prevent the electrooptic element from emitting light unnecessarily after the data erase.

According to the fifth or twelfth aspect of the present invention, by making the data erasing potential applied to the second control line to be not lower than the sum of the potential of the first power supply line and the threshold voltage of the erasing transistor, it is possible to reliably control the electrooptic element to be in the non-light-emitting state during the data erase.

According to the sixth or thirteenth aspect of the present invention, it is possible, without increasing the number of power supply or wiring, to obtain a display device capable of performing time-division gradation driving and preventing the electrooptic element from unnecessarily emitting light along with the changes of the potentials of the control lines.

According to the seventh or fourteenth aspect of the present invention, it is possible, without increasing the number of power supply or wiring, to obtain an organic EL display capable of preventing the electrooptic element from unnecessarily emitting light along with the changes of the potentials of the control lines.

BRIEF DESCRIPTION OF THE DRAWINGS

FIG. 10 is a circuit diagram of a pixel circuit according to a comparative example.

FIG. 11 is a timing chart of the pixel circuit shown in FIG. 10.

MODE FOR CARRYING OUT THE INVENTION

A display device according to an embodiment of the present invention will be described below with reference to the drawings. The display device according to the embodiment of the present invention is provided with a pixel circuit including an electrooptic element, a capacitor, a driving transistor, a writing transistor, and an erasing transistor. The pixel circuit includes an organic EL element as the electrooptic element, and TFTs as the three types of transistors. The TFTs included in the pixel circuit are formed using low-temperature polysilicon, for example. In the following description, n, m, and p are integers not smaller than 2, i is an integer not smaller than 1 and not greater than n, j is an integer not smaller than 1 and not greater than m, and k is an integer not smaller than 1 and not greater than p.

Figure 1:
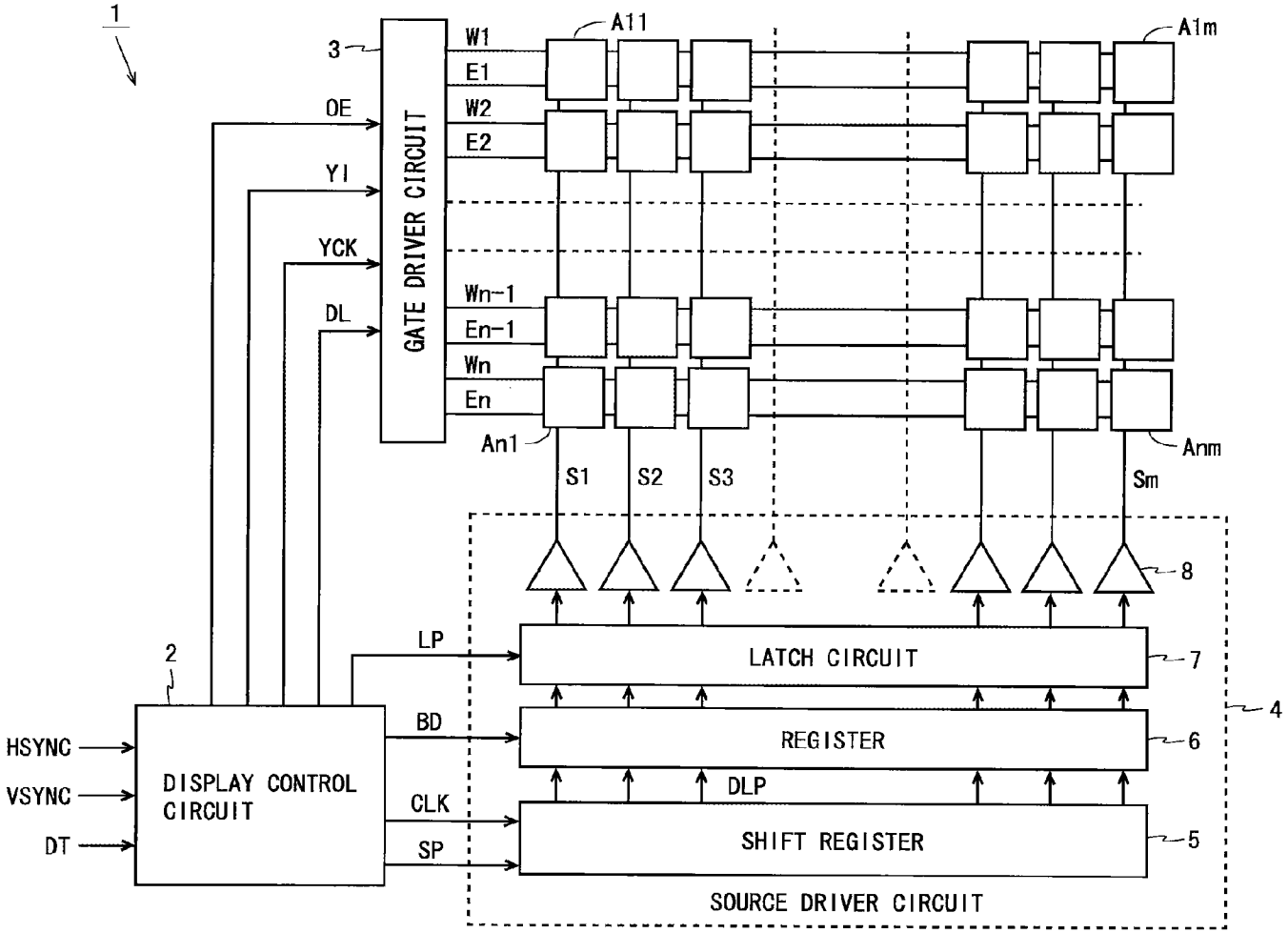
FIG. 1 is a block diagram illustrating a configuration of a display device according to an embodiment of the present invention.

FIG. 1 is a block diagram illustrating a configuration of a display device according to the embodiment of the present invention. A display device 1 shown in FIG. 1 is provided with a plurality of pixel circuits Aij, a display control circuit 2, a gate driver circuit 3, and a source driver circuit 4. The pixel circuits Aij are arranged two-dimensionally by providing m pixel circuits in each row and n pixel circuits in each column. A pair of two types of control lines Wi and Ei are provided for each line of the pixel circuits Aij, and a data line Sj is provided for each column of the pixel circuits Aij. The pixel circuits Aij are provided respectively corresponding to intersections between the control lines Wi and the data lines Sj.

The control lines Wi and Ei are connected to the gate driver circuit 3, and the data line Sj is connected to the source driver circuit 4. Potentials of the control lines Wi and Ei are controlled by the gate driver circuit 3, and a potential of the data line Sj is controlled by the source driver circuit 4. Further, although not shown in FIG. 1, in an area in which the pixel circuits Aij are arranged, a power supply line Vp and a common cathode Vcom are provided in order to supply power-supply voltages to the pixel circuits Aij.

To the display device 1, control signals such as a vertical synchronization signal VSYNC and a horizontal synchronization signal HSYNC, and display data DT having a width of two or more bits are inputted. The display device 1 performs $2^p$-level gradation display based on time-division gradation driving in which one frame period is divided into p sub-frame periods.

The display control circuit 2 outputs, based on the inputted control signals, an output enable signal OE, a start pulse YI, a clock YCK, and a delay time signal DL to the gate driver circuit 3, and outputs a start pulse SP, a clock CLK, and a latch pulse LP to the source driver circuit 4. The start pulses YI and SP are outputted every sub-frame period. The delay time signal DL specifies delay time from data write to data erase for each sub-frame period. In addition, the display control circuit 2 outputs, based on the display data DT, (m×n) pieces of binary display data (hereinafter referred to as binary data BD) for each sub-frame period.

The gate driver circuit 3 includes a shift register circuit, a write signal generating circuit, an erase signal generating circuit, and a buffer (none of these are shown). The start pulse YI becomes a predetermined level (for example, high level) at the beginning of each sub-frame period. The shift register circuit sequentially transfers the start pulse YI in synchronization with the clock YCK. The write signal generating circuit performs a logical operation between a pulse outputted from each stage in the shift register circuit and the output enable signal OE. An output from the write signal generating circuit is supplied to the corresponding control line Wi through the buffer. The erase signal generating circuit outputs a signal that changes to a high level with a delay of time specified by the delay time signal DL from the output from the write signal generating circuit and that changes to a low level when the output from the write signal generating circuit next becomes a high level. An output from the erase signal generating circuit is supplied to the corresponding control line Ei through the buffer.

The potential of the control line Wi and the potential of the control line Ei are controlled to be a high level once in a sub-frame period. When the potential of the control line Wi becomes a high level, one row of the pixel circuits Aij is selected for data write. When the potential of the control line Ei becomes a high level, one row of the pixel circuits Aij is selected for data erase. In this manner, the pixel circuit Aij is selected p times in a frame period for writing data and erasing data. As described above, the gate driver circuit 3 functions as a control line drive circuit for selecting the pixel circuits Aij as a target of data write using the control line Wi and selecting the pixel circuits Aij as a target of data erase using the control line Ei.

The source driver circuit 4 includes an m-bit shift register 5, a register 6, a latch circuit 7, and m buffers 8. The shift register 5 includes m 1-bit registers that are cascade-connected. The shift register 5 sequentially transfers the start pulse SP in synchronization with the clock CLK, and outputs a timing pulse DLP from a register of each stage. In synchronization with timing to output the timing pulse DLP, the register 6 is supplied with the binary data BD relating to the current sub-frame period. The register 6 stores the binary data BD according to the timing pulse DLP. Upon storing of the binary data BD for one row in the register 6, the display control circuit 2 outputs the latch pulse LP to the latch circuit 7. Upon reception of the latch pulse LP, the latch circuit 7 holds the binary data stored in the register 6.

The buffers 8 are provided corresponding to the data lines Sj, and each applies a potential according to the binary data held in the latch circuit 7 to the corresponding data line Sj. More specifically, the buffer 8 applies a low level potential to the data line Sj when the held binary data is white data (data corresponding to the light-emitting state of an organic EL element 15), and applies a high level potential to the data line Sj when the held binary data is black data (data corresponding to the non-light-emitting state of the organic EL element 15). As described above, the source driver circuit 4 functions as a data line drive circuit for applying a potential corresponding to the piece of binary display data to the data line Sj.

Figure 2:
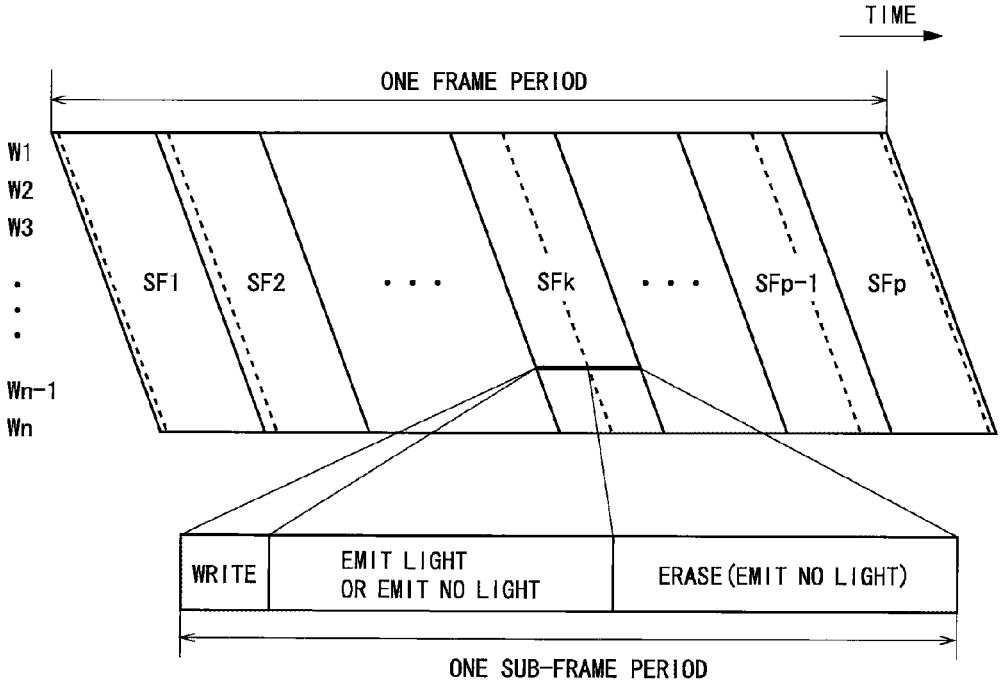
FIG. 2 is a timing chart of time-division gradation driving performed by a display circuit shown in FIG. 1.

FIG. 2 is a timing chart of time-division gradation driving performed by the display device 1. Referring to FIG. 2, one frame period is divided into p sub-frame periods. In each sub-frame period, the potential of the control line Wi is controlled to be a high level, and data write is performed to one row of the pixel circuits Aij sequentially. After the data write ends, the state of the organic EL element in the pixel circuit Aij becomes the light-emitting state or the non-light-emitting state depending on the written data.

The potential of the control line Ei is controlled to be a high level with a delay of a predetermined time from the control line Wi, and data erase is performed to one row of the pixel circuits Aij. The potential of the control line Ei is maintained at a high level until the potential of the control line Wi next becomes a high level. Accordingly, the organic EL element in the pixel circuit Aij is controlled to be in the non-light-emitting state until the data write is next performed. A period from the data write to the data erase corresponds to a light-emitting period of the organic EL element in each sub-frame period. A length of this period is specified by the delay time signal DL outputted from the display control circuit 2 to the gate driver circuit 3.

For example, when the width of the display data DT is 8 bits, one frame period is divided into 8 sub-frame periods, a ratio among the light-emitting periods of the organic EL element in the first to the eighth sub-frame period is assumed to be $2^0:2^1:2^2:2^3:2^4:2^5:2^6:2^7$. In this case, a k-th bit of the display data DT from low order is used as it is as the binary data BD relating to a k-th sub-frame period. Here, although the display device 1 performs time-division gradation driving according to the timing chart shown in FIG. 2, the display device 1 can perform time-division gradation driving other than this example.

Figure 3:
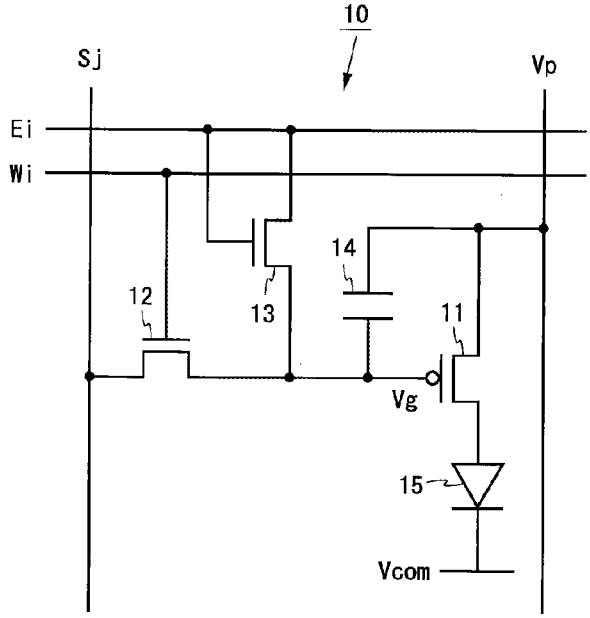
FIG. 3 is a circuit diagram of a pixel circuit included in the display circuit shown in FIG. 1.

FIG. 3 is a circuit diagram of the pixel circuit Aij included in the display device 1. A pixel circuit 10 shown in FIG. 3 includes a driving TFT 11, a writing TFT 12, an erasing TFT 13, a capacitor 14, and the organic EL element 15. The driving TFT 11 is a P-channel type transistor, and the writing TFT 12 and the erasing TFT 13 are N-channel type transistors. The pixel circuit 10 corresponds to the pixel circuit Aij in FIG. 1.

The pixel circuit 10 is connected to a power supply line Vp, a common cathode Vcom, the control lines Wi and Ei, and the data line Sj. The common cathode Vcom constitutes a common electrode for all the organic EL elements 15 in the display device 1. In the pixel circuit 10, a source terminal of the driving TFT 11 is connected to the power supply line Vp, and a drain terminal of the driving TFT 11 is connected to an anode terminal of the organic EL element 15. A cathode terminal of the organic EL element 15 is connected to the common cathode Vcom. The writing TFT 12 is provided between a gate terminal of the driving TFT 11 and the data line Sj. The erasing TFT 13 is provided between the gate terminal of the driving TFT 11 and the control line Ei. A gate terminal of the writing TFT 12 is connected to the control line Wi, and a gate terminal of the erasing TFT 13 is connected to the control line Ei. The capacitor 14 is provided between the gate terminal and the source terminal of the driving TFT 11. Hereinafter, a gate potential of the driving TFT 11 is referred to as Vg. Out of conducting terminals of the writing TFT 12, a terminal on a side of the data line Sj is referred to as a first terminal and a terminal on a side of the driving TFT 11 is referred to as a second terminal.

The gate terminal and a drain terminal of the erasing TFT 13 are both connected to the control line Ei. The erasing TFT 13 that is connected in this manner functions as a diode. More specifically, when the potential of the control line Ei is higher than the gate potential Vg, a current flows from the control line Ei to the gate terminal of the driving TFT 11 through the erasing TFT 13, and the gate potential Vg rises to finally become equal to the potential of the control line Ei (more correctly, a potential resulting from subtraction of a threshold voltage of the erasing TFT 13 from the potential of the control line Ei). By contrast, when the potential of the control line Ei is lower than the gate potential Vg, a current does not flow through the erasing TFT 13, and the gate potential Vg does not change. As described above, the erasing TFT 13 provides a rectifying effect causing a current to flow only in a direction from the control line Ei toward the gate terminal of the driving TFT 11.

Figure 4:
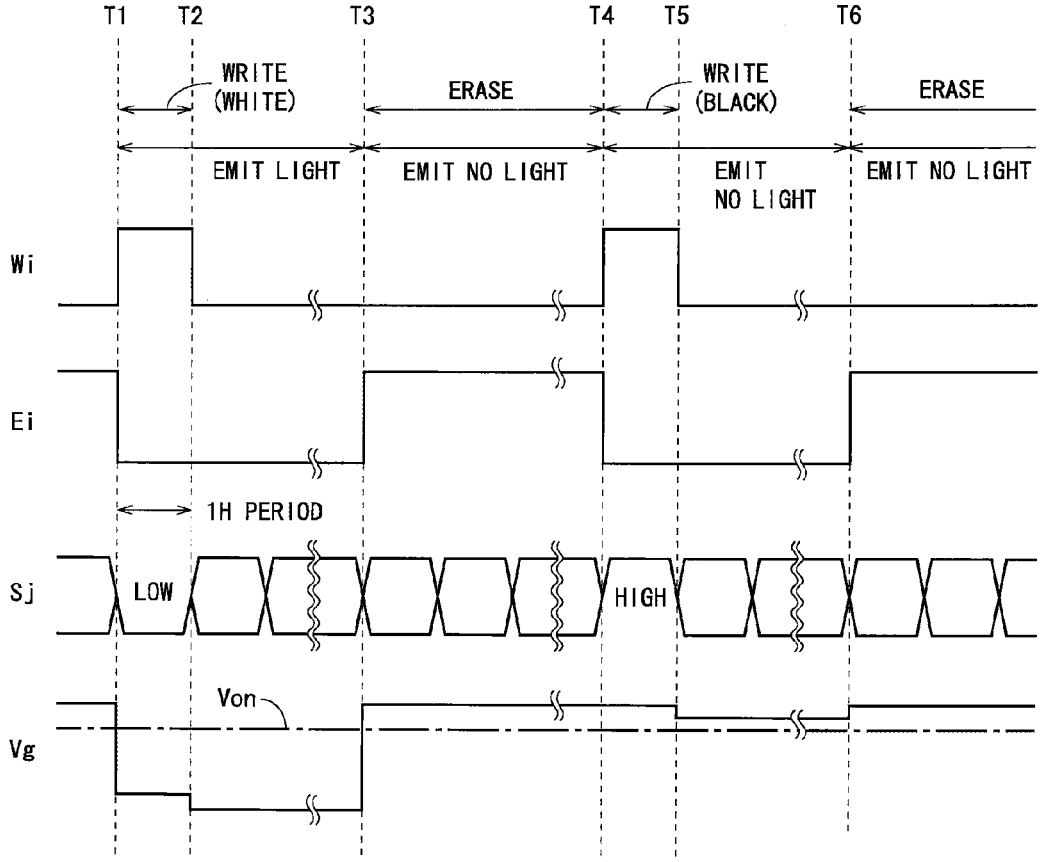
FIG. 4 is a timing chart of the pixel circuit shown in FIG. 3.

FIG. 4 is a timing chart of the pixel circuit 10. FIG. 4 shows changes in the potentials of the control lines Wi and Ei and the data line Sj and a change in the gate potential Vg. Referring to FIG. 4, when data is written to the pixel circuit 10, the potential of the control line Wi is controlled to be a high level only for one horizontal scanning period (1H period). Along with this, the potential of the data line Sj is controlled to be a low level when white data is written, and controlled to be a high level when black data is written. When erasing the written data, the potential of the control line Ei is controlled to be a high level. The potential of the control line Ei changes to a low level when the potential of the control line Wi next becomes a high level. In other words, the potential of the control line Ei is maintained at a high level while the potential of the control line Wi is at a low level.

In FIG. 4, a time period from a time point T1 to a time point T2 is a writing period for white data, a time period from the time point T1 to a time point T3 is a light-emitting period of the organic EL element 15 based on the white data, a time period from the time point T3 to a time point T4 is a data erasing period, a time period from the time point T4 to a time point T5 is a writing period for black data, a time period from the time point T4 to a time point T6 is a non-light-emitting period of the organic EL element 15 based on the black data, and a time period at and after the time point T6 is a data erasing period. In the data erasing period, the organic EL element 15 is in the non-light-emitting state.

Figure 5:
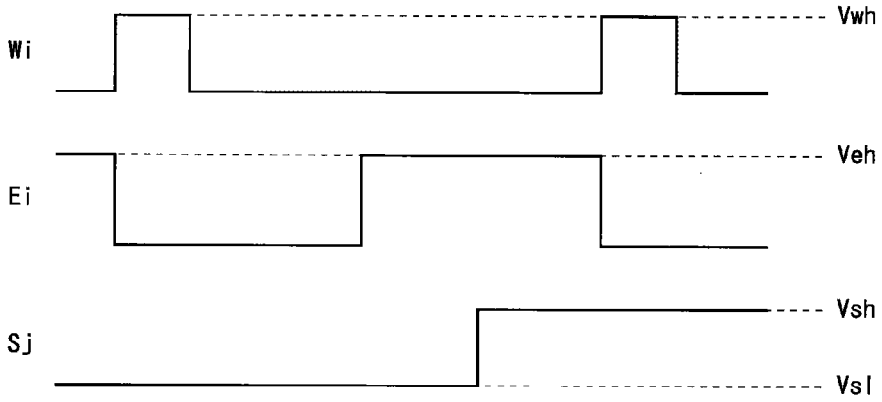
FIG. 5 is a diagram of potentials to be applied to the pixel circuit shown in FIG. 3.
Figure 6:
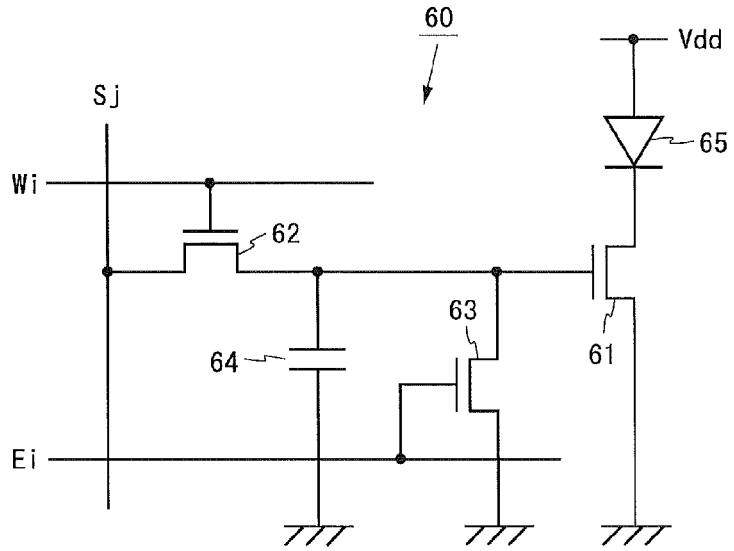
Fig. 6 Prior Art
FIG. 6 is a circuit diagram of a pixel circuit (first example) included in a conventional display device.
Figure 7:
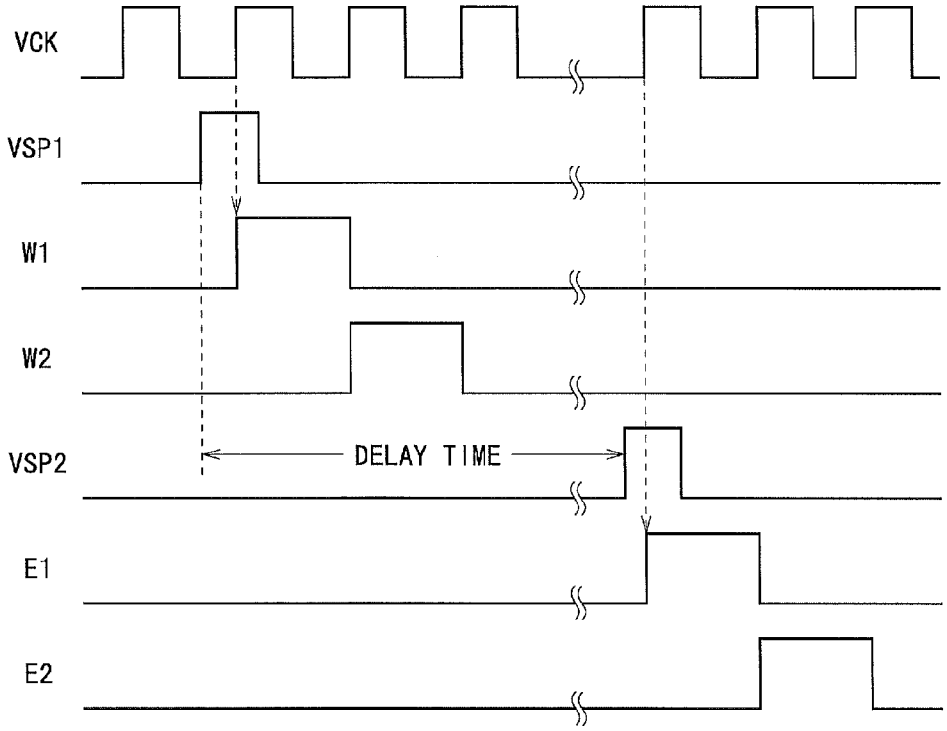
Fig. 7 Prior Art
FIG. 7 is a timing chart of the pixel circuit shown in FIG. 6.
Figure 8:
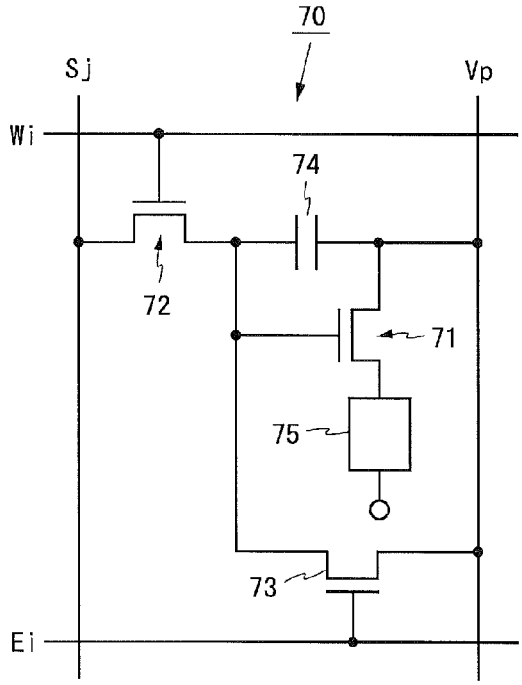
Fig. 8 Prior Art
FIG. 8 is a circuit diagram of a pixel circuit (second example) included in a conventional display device.
Figure 9:
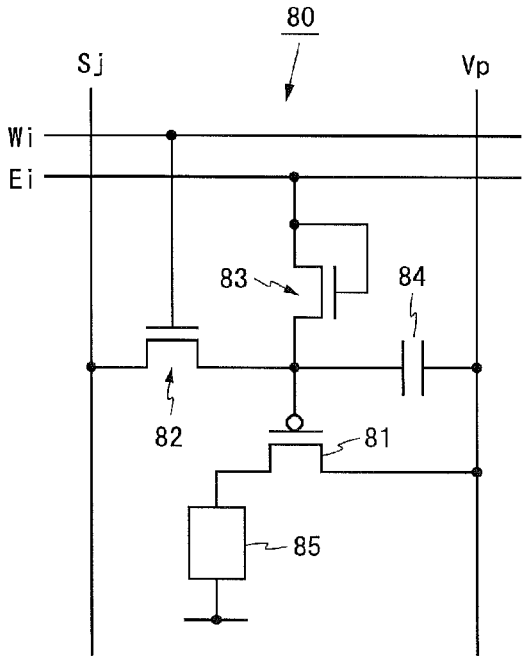
Fig. 9 Prior Art
FIG. 9 is a circuit diagram of a pixel circuit (third example) included in a conventional display device.

Here, as shown in FIG. 5, a high level potential applied to the control line Wi is taken as Vwh, a high level potential applied to the control line Ei is taken as Veh, a high level potential applied to the data line Sj (corresponding to the black data) is taken as Vsh, and a low level potential applied to the data line Sj (corresponding to the white data) is taken as Vsl. Further, the potential of the power supply line Vp is taken as Vdd, and the threshold voltage of the erasing TFT 13 is taken as Vth.

In the display device 1, these potentials are determined so as to satisfy three conditions listed below.

(1) The high level potential Vwh applied to the control line Wi is a potential at which the writing TFT 12 is maintained in the OFF state when the potential applied to the data line Sj is the high level potential Vsh.

(2) The high level potential Veh applied to the control line Ei is not lower than a sum of the potential Vdd of the power supply line Vp and the threshold voltage Vth of the erasing TFT 13 ($Veh \geq Vdd+Vth$).

(3) The low level potential Vsl applied to the data line Sj is a potential at which the driving TFT 11 operates in a linear state when this potential is applied to its gate terminal.

Alternatively, the first condition can be further limited to satisfy a fourth condition listed below. In this case, a fifth condition listed below can be further satisfied.

(4) The high level potential Vwh applied to the control line Wi is equal to the high level potential Vsh applied to the data line Sj ($Vwh=Vsh$).

(5) The high level potential Vsh applied to the data line Sj is equal to the potential Vdd applied to the power supply line Vp ($Vsh=Vdd$).

An operation of the pixel circuit 10 will be described below with reference to FIG. 4. Here, it is assumed that the first to fifth conditions are satisfied. In a period before the time point T1, the gate potential Vg is at a high level. The gate potential Vg at this time is taken as Vgh.

At the time point T1, the potential of the control line Wi changes to a high level, and the potential of the control line Ei changes to a low level. Further, in the time period from the time point T1 to the time point T2, the potential of the data line Sj is controlled to be a low level. At this time, a gate potential of the writing TFT 12 is Vwh, a potential of the first terminal is Vsl, and a potential of the second terminal is Vgh. As the potential of the first terminal is lower than the potential of the second terminal, the first terminal constitutes a source terminal and the second terminal constitutes a drain terminal. As the gate potential Vwh is sufficiently higher than the source potential Vsl, the writing TFT 12 is turned to the ON state. Therefore, a current flows from the gate terminal of the driving TFT 11 to the data line Sj through the writing TFT 12, and the gate potential Vg drops and becomes equal to the potential Vsl of the data line Sj. Thus, at and after the time point T1, the driving TFT 11 is turned to the ON state, a current that passes through the driving TFT 11 and the organic EL element 15 flows between the power supply line Vp and the common cathode Vcom, and the organic EL element 15 emits light. It should be noted that as the potential of the control line Ei is lower than the gate potential Vg during this time, no current flows through the erasing TFT 13.

At the time point T2, when the potential of the control line Wi changes to a low level, the writing TFT 12 is turned to the OFF state. At this time, as the capacitor 14 maintains a potential difference between the electrodes, the gate potential Vg is maintained at a low level at and after the time point T2. Therefore, at and after the time point T2, the driving TFT 11 remains in the ON state, the current that passes through the driving TFT 11 and the organic EL element 15 flows between the power supply line Vp and the common cathode Vcom, and the organic EL element 15 emits light.

It should be noted that, as there is a parasitic capacitance (not shown) between the gate terminal of the writing TFT 12 and the second terminal, the gate potential Vg drops when the potential of the control line Wi changes to a low level at the time point T2. As the organic EL element 15 still emits light even though the gate potential Vg drops at this time, there is no problem in an operation of the pixel circuit 10.

In the time period from the time point T3 to the time point T4, the potential of the control line Ei is controlled to be a high level. At the time point T3, when the potential of the control line Ei becomes higher than the gate potential Vg, a current flows from the control line Ei to the gate terminal of the driving TFT 11 through the erasing TFT 13, and the gate potential Vg rises and becomes equal to the potential Veh of the control line Ei (more correctly, a potential resulting from subtraction of the threshold voltage Vth of the erasing TFT 13 from the potential Veh). The gate potential Vg at this time is Vgh described above.

While the gate potential Vg is at a high level, the driving TFT 11 remains in the OFF state, and no current flows through the driving TFT 11 and the organic EL element 15, and the organic EL element 15 does not emit light. Therefore, by controlling the potential of the control line Ei to be a high level in the time period from the time point T3 to the time point T4, the organic EL element 15 is controlled to be in the non-light-emitting state.

At the time point T4, the potential of the control line Wi changes to a high level, and the potential of the control line Ei changes to a low level. Further, in the time period from the time point T4 to the time point T5, the potential of the data line Sj is controlled to be a high level. At this time, the gate potential of the writing TFT 12 is Vwh, the potential of the first terminal is Vsh, and the potential of the second terminal is Vgh. From the first, fourth, and fifth conditions, a relation of $Vwh=Wsh \leq Vgh$ is established among the three potentials.

Here, taking the first terminal as the source terminal and the second terminal as the drain terminal, there is no potential difference between the gate and the source of the writing TFT 12. Taking the first terminal as the drain terminal and the second terminal as the source terminal by contrast, the gate potential is not sufficiently higher than the source potential. Therefore, regardless of the terminal taken as the source terminal, the writing TFT 12 is not turned to the ON state when the potential of the control line Wi is changed to a high level at the time point T4.

Accordingly, also at and after the time point T4, the writing TFT 12 is maintained in the OFF state, and the gate potential Vg is maintained at the high level. Therefore, also at and after the time point T4, the driving TFT 11 is maintained in the OFF state, no current flows through the driving TFT 11 and the organic EL element 15, and the organic EL element 15 does not emit light.

At the time point T5, even though the potential of the control line Wi changes to a low level, the state of the pixel circuit 10 does not change and the organic EL element 15 is maintained in the non-light-emitting state. As there is a parasitic capacitance (not shown) between the gate terminal of the writing TFT 12 and the second terminal, the gate potential Vg drops when the potential of the control line Wi changes to a low level at the time point T5. Therefore, by making the high level potential to be applied to the control line Ei sufficiently high including a margin, the organic EL element 15 can be controlled to be in the non-light-emitting state even if the gate potential Vg drops.

At and after the time point T6, the potential of the control line Ei is again controlled to be a high level. The state of the pixel circuit 10 at and after the time point T6 is the same as that in the time period from the time point T3 to the time point T4.

As described above, in the display device 1 according to this embodiment, the high level potential for data erase is applied to the control line Ei until the potential applied to the control line Wi changes to the high level potential for data write (see FIG. 4). Further, the high level potential for data write applied to the control line Wi is a potential at which the writing TFT 12 is maintained in the OFF state when the potential applied to the data line Sj is a high level potential corresponding to the non-light-emitting state of the organic EL element 15.

As described above, according to the display device 1, the data erase to the pixel circuit 10 is performed and the organic EL element 15 is controlled to be in the non-light-emitting state until the data write is performed to the pixel circuit 10. Further, when writing the black data corresponding to the non-light-emitting state of the organic EL element 15 to the pixel circuit 10, the writing TFT 12 is maintained in the OFF state. Accordingly, it is possible to control the organic EL element 15 to be in the non-light-emitting state corresponding to the black data without writing the black data, and to prevent the gate potential of the driving TFT 11 from changing along with the change of the potential of the control line Wi when the data write ends. Therefore, it is possible to prevent the organic EL element 15 from emitting light unnecessarily after writing of the black data.

Moreover, by making the high level potential for data write applied to the control line Wi equal to the high level potential applied to the data line Sj (corresponding to the black data), it is possible to prevent the organic EL element 15 from emitting light unnecessarily after writing of the black data without increasing power supply for generating the data writing potential. In addition, by making the high level potential applied to the data line Sj equal to the potential of the power supply line Vp, it is possible to prevent the organic EL element 15 from emitting light unnecessarily after writing of the black data without increasing power supply for generating the potential corresponding to the black data.

Further, the erasing TFT 13 is provided between the gate terminal of the driving TFT 11 and the control line Ei. In this manner, by connecting one of the conducting terminals and the gate terminal of the erasing TFT 13 to the control line Ei, it is possible to apply an adequate potential to the gate terminal of the driving TFT 11 using the control line Ei, and to reliably control the organic EL element 15 to be in the non-light-emitting state during the data erase. Moreover, by applying the potential including a margin to the control line Ei, even when the potential of the control line Ei changes and the gate potential of the driving TFT 11 changes when the data erase ends, it is possible to prevent the organic EL element 15 from emitting light unnecessarily after the data erase. In addition, by making the high level potential for data erase applied to the control line Ei to be not lower than the sum of the potential of the power supply line Vp and the threshold voltage of the erasing TFT 13, it is possible to reliably control the organic EL element 15 to be in the non-light-emitting state during the data erase.

Further, the gate driver circuit 3 and the source driver circuit 4 perform time-division gradation driving in which one frame period is divided into a plurality of sub-frame periods and the state of the organic EL element 15 is controlled in each sub-frame period. Therefore, it is possible, without increasing the number of power supply or wiring, to obtain an organic EL display capable of performing time-division gradation driving and preventing the organic EL element 15 from unnecessarily emitting light along with the changes of the potentials of the control lines Wi and Ei.

As described above, according to the display device of the present invention, without increasing the number of wiring or power supply, it is possible to prevent the electrooptic elements from unnecessarily emitting light along with the changes of the potentials of the control lines.

INDUSTRIAL APPLICABILITY

The display device according to the present invention provides an advantageous effect of preventing the electrooptic elements from unnecessarily emitting light along with the changes of the potentials of the control lines without increasing the number of wiring or power supply, and therefore can be utilized for a current-driven type display device such as an organic EL display.

DESCRIPTION OF REFERENCE CHARACTERS

1: display device
2: display control circuit
3: gate driver circuit
4: source driver circuit
5: shift register
6: register
7: latch circuit
8: buffer
10: pixel circuit
11: driving TFT
12: writing TFT
13: erasing TFT
14: capacitor
15: organic EL element
Wi, Ei: control line
Sj: data line

The invention claimed is:

1. A display device of a current-driven type, the display device comprising:

a plurality of pixel circuits arranged two-dimensionally;

a plurality of first control lines and a plurality of second control lines, each first control line and each second control line being provided for each row of the pixel circuits;

a plurality of data lines, each provided for each column of the pixel circuits;

a control line drive circuit configured to select pixel circuits as a target of data write using the first control lines, and to select pixel circuits as a target of data erase using the second control lines; and a data line drive circuit configured to apply potentials corresponding to binary display data to the data lines, wherein each pixel circuit includes:

an electrooptic element provided between a first power supply line and a second power supply line;

a driving transistor provided between the first power supply line and the second power supply line, and in series with the electrooptic element;

a writing transistor provided between a gate terminal of the driving transistor and a corresponding one of the data lines, and having a gate terminal connected to a corresponding one of the first control lines;

an erasing transistor provided between the gate terminal of the driving transistor and a predetermined signal line, and having a gate terminal connected to a corresponding one of the second control lines; and a capacitor provided between the gate terminal of the driving transistor and the first power supply line, the second control line is applied with a data erasing potential until a potential applied to the first control line changes to a data writing potential, and the first control line is applied with a potential at which the writing transistor is maintained in an OFF state when a potential applied to the data line is a non-light-emitting potential corresponding to a non-light-emitting state of the electrooptic element.

2. The display device according to claim 1, wherein the data writing potential applied to the first control line is equal to the non-light-emitting potential applied to the data line.

3. The display device according to claim 2, wherein the non-light-emitting potential applied to the data line is equal to a potential of the first power supply line.

4. The display device according to claim 1, wherein the erasing transistor is provided between the gate terminal of the driving transistor and the second control line.

5. The display device according to claim 4, wherein the data erasing potential applied to the second control line is not lower than a sum of a potential of the first power supply line and a threshold voltage of the erasing transistor.

6. The display device according to claim 1, wherein the control line drive circuit and the data line drive circuit perform time-division gradation driving in which one frame period is divided into a plurality of sub-frame periods and a state of the electrooptic element is controlled in each sub-frame period.

7. The display device according to claim 1, wherein the electrooptic element is configured as an organic EL element.

8. A method for driving a display device provided with: a plurality of pixel circuits arranged two-dimensionally; a plurality of first control lines and a plurality of second control lines, each first control line and each second control line being provided for each row of the pixel circuits; and a plurality of data lines, each provided for each column of the pixel circuits, each pixel circuit including:

an electrooptic element provided between a first power supply line and a second power supply line; a driving transistor provided between the first power supply line and the second power supply line, and in series with the electrooptic element; a writing transistor provided between a gate terminal of the driving transistor and a corresponding one of the data lines, and having a gate terminal connected to a corresponding one of the first control lines; an erasing transistor provided between the gate terminal of the driving transistor and a predetermined signal line, and having a gate terminal connected to a corresponding one of the second control lines; and a capacitor provided between the gate terminal of the driving transistor and the first power supply line, the method comprising:

a step of selecting pixel circuits as a target of data write using the first control lines;

a step of selecting pixel circuits as a target of data erase using the second control lines; and a step of applying potentials corresponding to binary display data to the data lines, wherein the second control line is applied with a data erasing potential until a potential applied to the first control line changes to a data writing potential, and the first control line is applied with a potential at which the writing transistor is maintained in an OFF state when a potential applied to the data line is a non-light-emitting potential corresponding to a non-light-emitting state of the electrooptic element.

9. The method for driving a display device according to claim 8, wherein the data writing potential applied to the first control line is equal to the non-light-emitting potential applied to the data line.

10. The method for driving a display device according to claim 9, wherein the non-light-emitting potential applied to the data line is equal to a potential of the first power supply line.

11. The method for driving a display device according to claim 8, wherein the erasing transistor is provided between the gate terminal of the driving transistor and the second control line.

12. The method for driving a display device according to claim 11, wherein the data erasing potential applied to the second control line is not lower than a sum of a potential of the first power supply line and a threshold voltage of the erasing transistor.

13. The method for driving a display device according to claim 8, wherein in the three steps, time-division gradation driving is performed, in which one frame period is divided into a plurality of sub-frame periods and a state of the electrooptic element is controlled in each sub-frame period.

14. The method for driving a display device according to claim 8, wherein the electrooptic element is configured as an organic EL element.

* * * * *